US006412648B1

(12) United States Patent
Woolnough et al.

(10) Patent No.: US 6,412,648 B1
(45) **Date of Patent: *Jul. 2, 2002**

(54) DISPLAY APPARATUS

(75) Inventors: Andrew Charles Woolnough, Gravesend; Jean Wilhelmine Harris, Winnersh; Sydney James Harris, Bramley Nr. Basingstoke, all of (GB)

(73) Assignee: EML Limited, Berkshire (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/580,712

(22) Filed: May 30, 2000

(30) Foreign Application Priority Data

Jun. 25, 1999 (EP) ..... 9914772

(51) Int. Cl.[7] ..... A47F 3/00
(52) U.S. Cl. ..... 211/128.1; 211/55; 40/124.2
(58) Field of Search ..... 211/128.1, 55; 40/124.2, 124.4, 124

(56) References Cited

U.S. PATENT DOCUMENTS

| | | | | | |
|---|---|---|---|---|---|
| 1,594,754 | A | * | 8/1926 | Reines | 211/55 X |
| 3,285,424 | A | * | 11/1966 | Emery | 211/55 |
| 3,298,538 | A | * | 1/1967 | Ganz et al. | 211/55 X |
| 3,612,292 | A | * | 10/1971 | Nervig | 211/55 X |
| 3,791,651 | A | * | 2/1974 | Barnum et al. | 211/55 X |
| 4,613,047 | A | | 9/1986 | Bushyhead et al. | 211/55 |
| 4,796,764 | A | | 1/1989 | Hardy | 211/184 |
| 4,892,198 | A | | 1/1990 | Johnson | 211/41 |
| 5,085,328 | A | * | 2/1992 | Evenson | 211/55 |
| 5,184,737 | A | * | 2/1993 | Hardy | 211/55 |
| 5,505,315 | A | * | 4/1996 | Carroll | 211/59.3 X |
| 5,930,926 | A | * | 8/1999 | Kaplan | 40/124.4 X |
| 6,116,433 | A | * | 9/2000 | Pursall | 211/55 |

FOREIGN PATENT DOCUMENTS

| | | | |
|---|---|---|---|
| EP | 2025568 | 11/1986 | A47F/7/14 |
| EP | 0 344 830 | 12/1989 | A47F/7/14 |
| FR | 2037703 | 12/1970 | A47F/5/00 |
| GB | 1337194 | 11/1973 | A47F/5/00 |
| GB | 1482997 | 8/1977 | A47F/5/00 |
| GB | 2121273 | 12/1983 | |
| GB | 2206035 A | 12/1988 | A47B/47/04 |
| GB | 2241155 | 8/1991 | A47B/96/02 |
| GB | 2279554 | 1/1995 | A47B/47/04 |
| GB | 2293538 | 4/1996 | A47B/47/00 |
| GB | 2317328 | 3/1998 | A47B/47/00 |
| WO | WO 96/16579 | 6/1996 | A47F/7/14 |
| WO | WO 98/54688 | 12/1998 | A47F/5/00 |

* cited by examiner

*Primary Examiner*—Daniel P. Stodola
*Assistant Examiner*—Erica B. Harris
(74) *Attorney, Agent, or Firm*—Nikolai & Mersereau, P.A.

(57) ABSTRACT

A modular display having upper and lower modules. Each module has a pair of upstanding walls and a base therebetween, to define an open ended receptacle. The lower end of the upper module and an upper part of the lower module have mutually engagable hanger parts for connecting the modules together by hanging the lower module from the upper module. A tube may be attached to the back side a lower module upstanding wall for spacing the lower module from a wall such that the modules are angled as desired to receive articles therein.

25 Claims, 8 Drawing Sheets

DISPLAY APPARATUS

This invention relates to a display apparatus, in particular but not exclusively for use in retail environments such as shops. The display apparatus of the invention may also be used e.g. in banks, hospitals, offices and indeed virtually anywhere that it is required to provide an attractive display of articles.

EP-A-0295869 discloses a display apparatus intended primarily for the displaying of laminar articles such as cards, leaflets, sheets, brochures and magazines. EP-A-0295869 further discloses a plurality of elongate channels suspended one below another, each channel being of generally J-shaped cross section for supporting articles in the trough thereby formed.

Each J-shaped trough has a longer arm and a shorter arm. The apparatus includes a support for supporting each lower J-shaped channel on the next higher J-shaped channel. The support includes a hook, which is provided on the longer arm of each lower J-shaped channel and which hooks over the shorter arm of the next higher J-shaped channel whereby each lower J-shaped channel is suspended from the shorter, forward arm of the next higher J-shaped channel so as to provide a suspended tiered display.

The apparatus of EP-A-0295869 may be readily dismantled for transportation, storage and replacement.

Nonetheless, the apparatus of EP-A-0295869 suffers numerous drawbacks.

Primary amongst the drawbacks is the fact that each lower J-shaped channel is suspended from the shorter arm (i.e. the front arm) of the upwardly adjacent J-shaped channel. This means that, in order to provide a visually attractive display, all the J-shaped channels must have longer and shorter arms of the same respective lengths.

Also, the formation of the upper end of the longer arm of each J-shaped channel as a hook, that hooks over the shorter arm of the next upwardly adjacent J-shaped channel, means that some of the space, between the shorter and longer arms defining the trough for displaying articles, is occupied by the material of the hook. This limits the available distance between the front and rear arms, and hence the quantity of articles that can be displayed in the apparatus of EP-A-0295869. This is important when the articles displayed are, e.g. greetings cards.

Another disadvantage of the apparatus of EP-A-0295869 is that the longer wall of each lower J-shaped channel overlies the shorter wall of the next, upwardly adjacent channel. This means that the overlapping faces of the longer and shorter arms must be free of protuberances, otherwise the hook defined at the upper end of each longer arm cannot be successfully hung from the adjacent shorter arm.

According to a first aspect of the invention there is provided an apparatus having upper and lower modules with mutually engageable connector parts proximate the base and top, respectively, for releasably securing the base of the upper module to the top of the lower module.

This apparatus enjoys numerous advantages over the apparatus EP-A-0295869.

The locating of mutually engagable connector parts respectively at the base portion of an upper module and at an upper part of a lower module means that it is not necessary to provide a hook for hooking the lower module onto the front wall of the upper module. In turn this means that the upper edge of each front wall of each module is free. This in turn means that at least the front wall of the apparatus may be decorated, e.g., by means of the addition embellishments, or by virtue of having a non-rectilinear upper edge.

The apparatus of the invention remains readily dismantleable and reassemblable. The absence of any attachment involving the front wall of the receptacle means that the front wall at least may be made to any height to suit the application under consideration. This in turn provides the option of having differently sized modules within a single display, without any detrimental effect on the overall visual attractiveness of the display.

In preferred embodiments of the invention a lower part of the rear wall of each channel is provided by the rear wall of the lower module, and an upper part of the rear wall of each receptacle is provided by the front wall of an upper module. This advantageously permits two parts of the rear wall of the receptacle to be, e.g., of different colours. This may be desirable in producing an attractive appearance even when the display apparatus is empty.

Further, advantageous features of the invention are defined in the dependent claims.

The specification defines features that permit the connecting together, in a tiered display, of more than two of the modules of the apparatus.

The specification defines the boundary between the rear wall of a lower module and the front wall of the next upwardly adjacent module. The use of a substantially contiguous boundary advantageously provides a neat, attractive appearance to the display apparatus.

Optionally, the said substantially contiguous boundary is non-rectilinear. This feature may be used to produce attractive visual effects, e.g. when the rear wall of the lower module is a different colour than the front wall of the upper adjacent module.

Preferably the rear wall of each lower module is generally parallel to the front wall of the upwardly adjoining module when the modules are connected together. This allows the apparatus conveniently to display flat laminar items such as greetings cards.

In an alternative arrangement, the rear wall of a lower module is not parallel to the front wall of the next upwardly adjoining module. This may be of benefit when displaying curved items.

In preferred embodiments, the upstanding walls of each module are of generally equal heights. This allows the manufacture of a standard module size, that may be used to build up a tiered display of virtually any preferred depth.

In the alternative, the apparatus may include a module whose upstanding walls are of unequal heights.

Obviously, a display apparatus may if desired may include both modules having walls of equal heights; and modules having walls of unequal heights, as required.

Conveniently at least the front wall of a said module may include ornamental features. An example of such an ornamental feature is that of a non-rectilinear free edge to the front wall of a module. Thus, for example, the said upper edge may include cut-outs or recesses to define a preferred image or pattern.

Another possibility is for the said front wall to include, e.g., embossments and/or recesses, to enhance the appearance of the display or for other purposes as disclosed hereinbelow.

The specification defines an advantageously simple means for connecting the upper portion of a lower module to the base portion of an upper module of the apparatus. It is inherent in the arrangement of the invention that the front wall of a said module need not be parallel to the rear wall of the module below, since the angle of the front wall does not determine the angle at which the rear wall is supported.

The specification defines further means for connecting the upper portion of a lower module to the base portion of an upper module.

The specification defines a particularly preferred embodiment of the invention, in which a base wall spaces the front and rear walls of the module. This allows the said walls to lie parallel to one another. Such an arrangement is highly suitable for displaying greetings cards and other laminar items.

The specification defines a further feature that advantageously assists in the display of thin, laminar items such as greetings cards.

The specification defines an elongate channel that permits the slidable retention in at least one of the modules of the apparatus of a movable divider for subdividing the interior of a said receptacle.

In preferred embodiments the channel for receiving the divider extends longitudinally from one end of the apparatus to the other parallel to the base portion of its associated module, although other shapes and positions for the channel are possible. The arrangement of the invention advantageously permits the presence of the channel, for receiving the divider, as a depression in the surface of a wall that results in a protuberance on the other side of the wall. This is because, in contrast with EP-A-0295869, there are no overlapping walls in the apparatus of the invention.

The specification defines convenient means by which the apparatus may be assembled and suspended.

The specification defines an arrangement by means of which the orientation of the apparatus, relative to a fixed surface such as a wall, may readily be adjusted. This improves the versatility of the apparatus.

The specification defines a further arrangement which the orientation of the 20 apparatus, relative to a fixed surface such as a wall, may readily be adjusted.

The specification defines another form of divider. Use of this divider is facilitated by the fact that the upper edge of each upstanding wall is free. Therefore the U-shaped portion of the divider can be a comparatively slim component. Assuming that the two upstanding walls are each of the same thickness, the U-shaped portion may be slidingly fitted over either of them. The divider may readily be removed from the apparatus, rotated through 180° and replaced. Thus the divider may project either forwardly or rearwardly relative to one of the upstanding walls, as required.

This apparatus is advantageously position-adjustable relative to a surface such as a wall, thereby being of greater versatility than the prior art arrangements.

There now follows a description of preferred embodiments of the invention, by way of non-limiting example, with reference being made to the accompanying drawings in which:

FIG. 1 is a side elevational view of a first embodiment of the invention;

FIG. 1*a* is a perspective view of a movable divider;

FIG. 2 is a side elevational view of a second embodiment of the invention, similar to the first embodiment, shown at a second orientation and including a second kind of slidable divider;

FIG. 2*a* is a perspective view of an another movable divider; and

FIG. 3 shows a third embodiment of the invention, similar to the first and second embodiments, shown at the same orientation as the second embodiment and including a third kind of slidable divider;

FIG. 3*a* is a perspective view of another movable divider;

FIG. 3*b* is a perspective view of the movable divider of FIG. 3*a* as used in a module;

FIG. 4 shows a fourth embodiment of the invention, including an alternative form of connecting strut;

FIG. 4*a* is a perspective view of a strut connector plate;

Figure 1A:
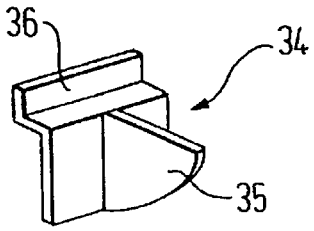

Referring to the drawings there is shown a display apparatus 10 according to the invention.

The apparatus 10 is a modular display apparatus comprising an upper module 11 and a lower module 16.

Figure 1:
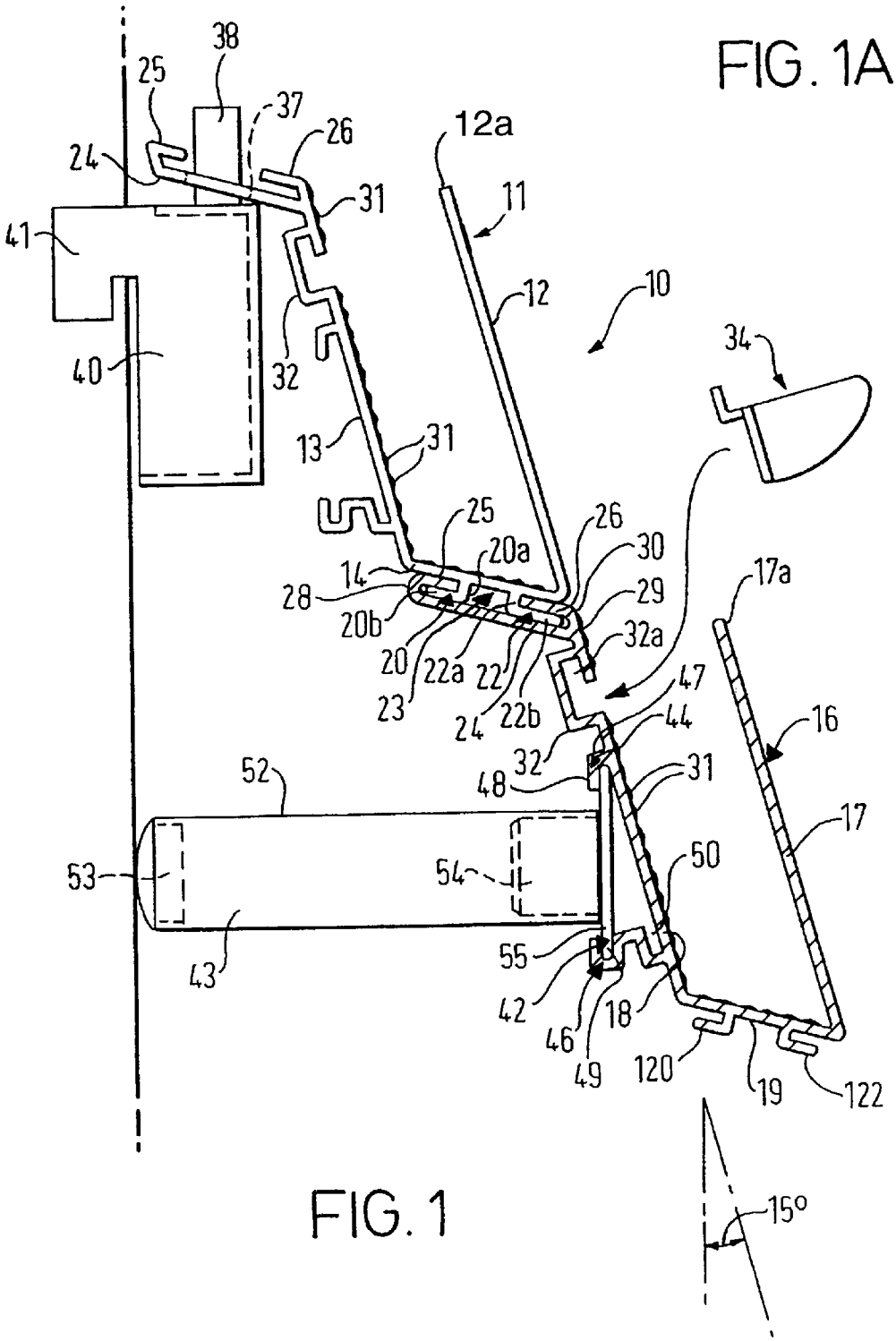

Module 11 includes a pair 12, 13 of upstanding side walls. Side walls 12, 13, in the embodiment of FIG. 1, are generally parallel to one another and spaced from one another in a horizontal direction. Walls 12, 13, in the FIG. 1 embodiment , are of generally the same length as each other, although this need not necessarily be so.

Walls 12, 13 are interconnected by a bottom wall 14 at the base portion of upper module 11.

The bottom wall 14 is inclined at an obtuse angle relative to rear wall 13, and at an acute angle to front wall 12 so that the walls 12, 13, 14 in the embodiment of FIG. 1 generally define three sides of a parallelogram or trapezium shape when viewed in cross section.

Thus the walls 12, 13, 14 define a first receptacle, open at its upper end in use of the display apparatus. The receptacle is dimensioned to be suitable for receiving articles for display (not shown in the drawings).

FIG. 1 shows a first, lower module 16, having substantially identical front and rear walls 17, 18 that are substantially parallel to one another and interconnected at the base portion of lower module 16 by bottom wall 19.

Thus the walls 17, 18, 19 define a further receptacle, similar to the receptacle of upper module 11, that is open at its upper end for receiving articles for display (not shown in the drawings).

Lower module 16 is suspended beneath upper module 11 by means of mutually engageable connector parts formed on or secured to the base portion of the upper module 11 and an upper portion of the first lower module 16.

The connector parts secured on the base portion of upper module 11 include a pair of flanged members 20, 22.

Each flanged member 20, 22 includes a generally downwardly extending wall 20*a*, 22*a* protruding perpendicular to the exterior of bottom wall 14; and a respective flange 20*b*, 22*b* extending generally perpendicular to each downwardly depending wall 20*a*, 22*a*. The flanges 20*b*, 22*b* are generally parallel to one another and when viewed in cross-section extend in mutually opposite directions, so that the flange members 20, 22 together define a T-shaped member for engagement with connector parts located at the top of the first lower module 16.

The flanges 20*b*, 22*b* extend for part or all of the length of the underside of bottom wall 14.

The connector parts at the top of first lower module 16 include a slot 23 of generally complementary shape to the T-shape defined by the flange members 20, 22. The slot 23 is defined by an elongate plate 24 extending from the upper end of rear wall 18, at an angle substantially parallel to that of bottom wall 14 of upper module 11, when walls 12 and 18 lie parallel to one another.

Extending parallel to plate 24, and spaced a short vertical distance above it, are two mutually parallel flanges 25, 26.

The flanges 25, 26 are spaced from one another by a central aperture extending along their respective lengths for receiving the flange members 20, 22.

Flange 25, that is remote from wall 18, is connected to plate 24 by means of an upstand 28.

Flange 26 is connected to a short extension 29 of the top of wall 18.

It will thus be apparent that by sliding the flange members, 20, 22 of upper module 11 into the slot 23 at the top of the first lower module 16, the two modules may be joined together in a releasable manner such that first lower module 16 is suspended beneath upper module 11. The connector parts therefore form a hanger for supporting the weight of the lower module.

Bottom wall 19 of first lower module 16 includes flange members 120, 122 identical to flange members 20, 22 of upper module 11. Thus a further article (typically but not necessarily a further module such as lower module 16) may thus be suspended from the base portion of first lower module 16.

Clearly if the further article is a further module similar or identical to first lower module 16, it is readily possible to build up a tiered display including a descending cascade of the receptacles. The tiered display may in theory have any number of modules, to suit the precise requirements of the installation.

In contrast with the arrangement of EP-A-0295869 the free upper end 12*a*, 17*a*, etc. of each front wall, 12, 17, etc. of each module is not used for suspending a lower module beneath an upper module. Consequently the outer face and upper edge of each such front wall are available for display and/or support purposes. Thus, for example, each upper edge can include an undulatory profile or another shape, thereby enhancing the appearance of the display when empty.

Also, the face of each front wall may include embossments, recesses, apertures, printed decorations, surface textures and the like that either are visually appealing or are of assistance in supporting articles to be displayed in the apparatus.

The arrangement of suspending an upper portion of the lower module from the base portion of an upper module may result in a neat, comparatively narrow line joint 30 between the two modules. If desired this line joint may also may be arranged to be non-rectilinear, or may be a straight line that is inclined for aesthetic purposes.

The angle at which the plate 24 and flanges 25, 26 protrude relative to the wall 18 determines whether wall 18 lies parallel to wall 12, or at an angle thereto. In some embodiments, e.g when it is desired to display curved articles, it is advantageous for wall 18 and wall 12 to be non-parallel, i.e for there to be an obtuse angle between the two walls to present a support surface whose gradient alters part way along its length.

Also, the walls 12 and 18 may readily be manufactured in different colours, in order to produce a chosen aesthetic effect when the display apparatus is empty.

In the embodiment shown, the front and rear walls of each module are of substantially the same height. In alternative embodiments, one of the walls (preferably but not necessarily the front wall 12 or 17) may be shorter than the rear wall 13, 18.

Since the overall depth of a tiered display of the modules is determined by the lengths of the rear walls 13, 18, if the rear walls 13, 18 are all of the same length the differently dimensioned front walls 12, 17 may be employed without having an adverse effect on the overall dimensions of the tiered display.

Each of the modules 11, 16 includes a series of ribs 31 formed parallel to one another and extending transversely of each rear wall 13, 18 and bottom wall 14, 19. The ribs assist in supporting laminar articles such as greetings cards in preferred locations in the apparatus.

Each of the modules 11, 16 shown in FIG. 1 includes, adjacent the upper end of its respective rear wall 13, 18, a protuberance 32 formed on the outer surface of the respective rear wall.

Each protuberance extends longitudinally along the length of the rear wall on which it is formed. The inner surface of the said wall includes an L-shaped slot 32*a* extending rearwardly into the protuberance. The L-shaped slot extends along the length of the protuberance 32. The slot 32*a* is intended to receive a moveable divider 34 for the receptacle of the module 11, 16.

The divider 34 includes a forwardly extending, laminar member 35 extending perpendicular to a support member 36 whose cross section is cranked to be of complementary shape to the L-shaped slot. It will thus be seen that the support member 36 may readily be inserted into the L-shaped slot at the top of each module, in order to support the laminar member 35 in a cantilever fashion. The divider 34 may be slid along the slot 32*a* to any chosen position in the associated module, in order to sub-divide the interior of the module.

The elongate plate 24 of at least the upper module 11 has formed therein a circular, though-going aperture 37. The diameter of aperture 37 is less than the distance separating the edges of the flanges 25, 26 above the aperture 37.

The aperture 37 permits the upper module 11 to be pivotally suspended by means of a pin 38 that is of smaller diameter than the aperture 37.

Pin 38 may be secured to a bracket or boss 40 that includes one or more projections 41 for rigid securing, e.g., to a slot wall.

Pin 38 may be secured to any other fast item to provide a suitable hanging point for the tiered display.

As shown in the embodiment of FIG. 1, pin 38 protrudes though aperture 37 and upwardly beyond the flanges 25, 26 via the space there between.

At least a lower module such as module 16 includes formed on the outer surface of its rear wall 18 a slot 42 for a strut 43.

Slot 42 is defined between an upper formation 44 and a lower formation 46.

Upper formation 44 includes an upper wall 47 protruding perpendicular to the outer surface of rear wall 18, preferably but not necessarily along the length thereof. A further wall 48 depends downwardly from upper wall 47 at an acute angle to wall 18, to define an inverted V-shaped channel.

Lower formation 46 is substantially sinusoidal in cross section as shown, and extends preferably but not necessarily along the length of the outer surface of wall 18.

Lower formation 46 is spaced downwardly from upper formation 44.

Lower formation 46 defines two generally parallel sided slots 49, 50 that are open at their upper ends and disposed opposite the inverted V-shaped slot defined by upper formation 44.

Parallel sided slot 50 extends generally parallel to wall 18; whereas parallel sided slot 49 extends generally parallel to further wall 48 of upper formation 44.

Strut 43 includes a tubular member 52 that in the as-manufactured state is open at either end.

The end of tubular member 52 remote from the display apparatus is closed by means of bung 53 inserted in the open end. Bung 53 has a domed outer surface to act as a bumper for bracing against a solid surface such as the slot wall-that supports the bracket 40.

The end of tubular member 52 adjacent display apparatus 10 receives inserted therein a further bung 54 that terminates at its free end in a flange 55 that protrudes outwardly beyond the extremity of tubular member 52.

The dimension of flange 55 in the vertical direction visible in FIG. 1 corresponds to the distance between juxtaposed pairs of slots defined by the upper and lower formations 44, 46. Therefore if flange 55 is slid into one of the slots 49, 50 and simultaneously into the V-shaped slot defined by upper formation 44, the strut 43 is retained slideably captive relative to the apparatus 10.

If the length of tubular member 52 is appropriately chosen, strut 43 spaces the lower portion of the display apparatus 10 from e.g the slot wall, and simultaneously braces the lower part of the display apparatus 10.

As shown in FIG. 1 the flange 55 is received in the V-shaped slot and in slot 49, to support the recesses defined by the modules at an angle relative to the slot wall. This allows for slight fanning of laminar articles displayed in the apparatus. It also ensures that any stack of flexible articles received in any of the modules is tilted backwards, thereby preventing the articles from flopping over forwardly.

Figure 2A:
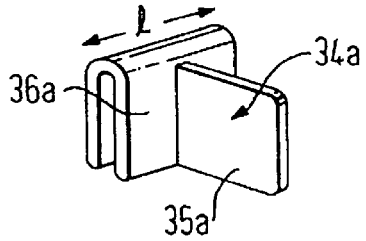
Figure 2:
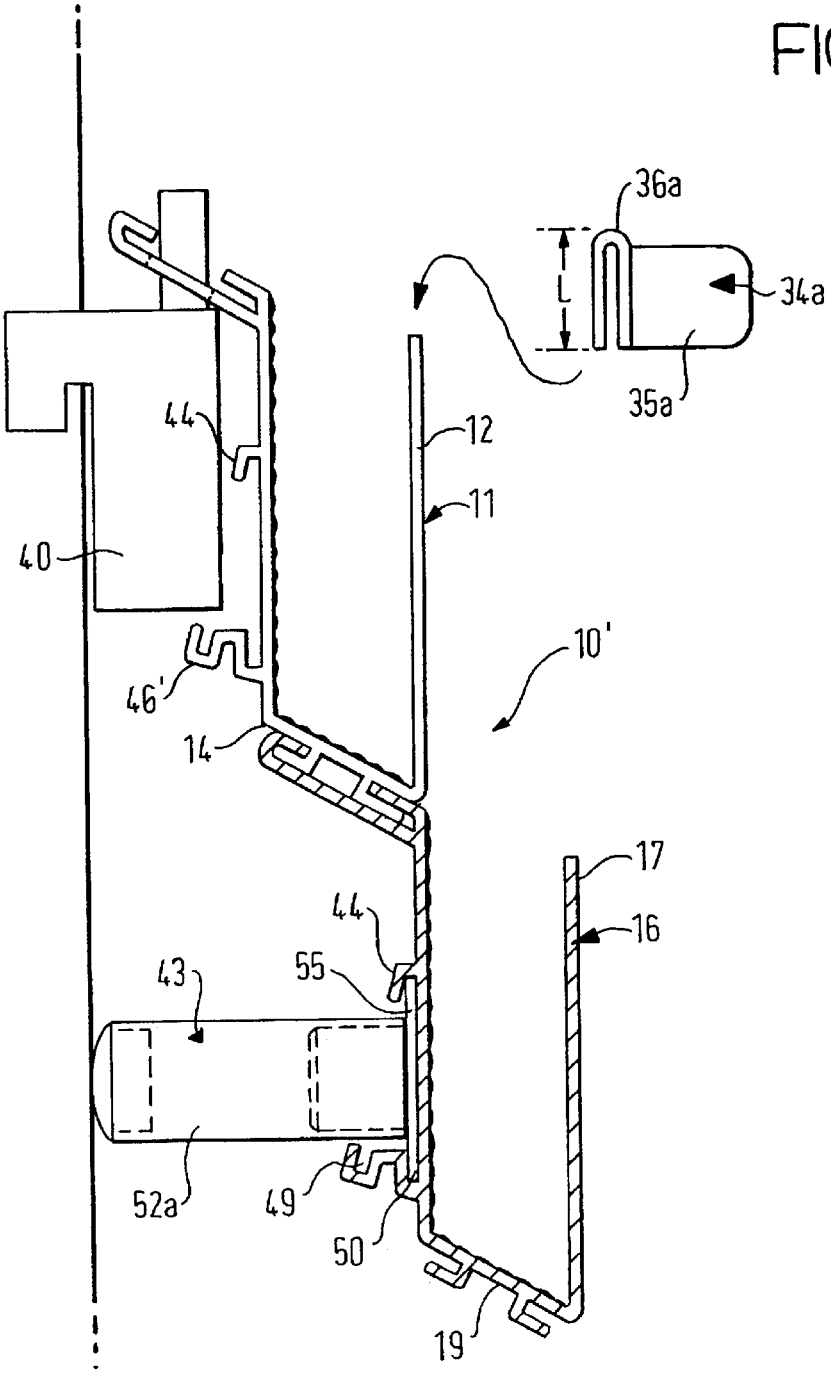

In FIG. 2, the lower portion of the flange 55 is received in parallel sided slot 50 instead of slot 49, while the upper end of flange 55 remains received in the inverted V-shaped slot defined by formation 44.

In this configuration, if a suitably shorter tubular member 52*a* is employed, the modules 11, 16 extend substantially vertically (i.e parallel to the slot wall, etc).

In this configuration articles displayed in the apparatus are fanned to a greater extent, by virtue of the greater downward inclination of the bottom walls 14, 19. Also, of course, the display 10 protrudes a lesser distance from the wall against which it is secured. Thus it is possible to employ the display in a more compact configuration that still exhibits advertising advantages.

Figure 3:
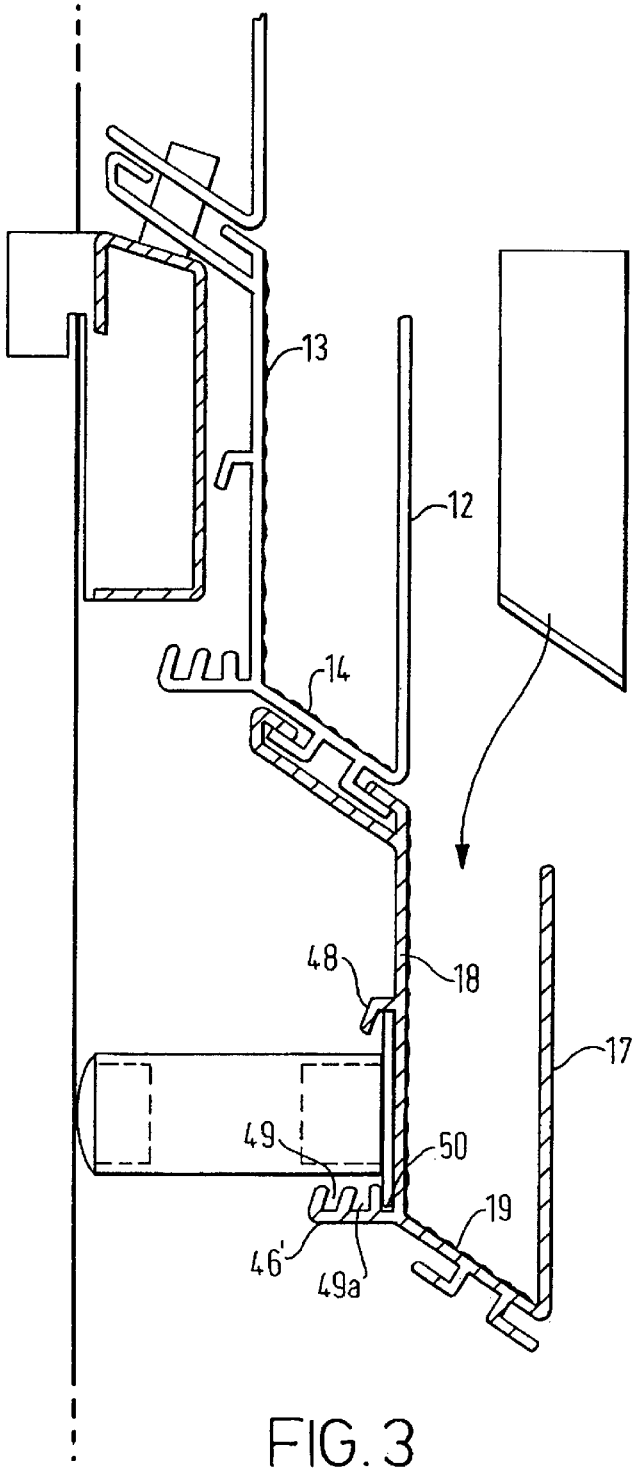

An alternative lower formation 46' is shown in FIG. 3. In this embodiment, the lower formation 46' includes two parallel sided slots 49, 50 that extend generally parallel to wall 48 and wall 18 respectively, and it also includes a further parallel sided slot 49*a*, provided between these two slots 49, 50. This further slot 49*a* extends generally at an angle between the angle of the other two slots 49, 50.

This further slot 49*a* allows mounting of the display in a further configuration in which the modules do not extend substantially vertically, but extend at an angle that is midway between the vertical position and the position defined by slot 49, relative to the slot wall.

In practice, although the aperture 37 and the formations 44, 46 are respectively described with regard to the upper 11 and lower 16 modules, in preferred embodiments all the modules of a plurality making up a tiered display would include both the aperture 37 and the formations 44, 46, in order to standardise the manufacturing process and assist in assembly of a display.

As is shown in FIG. 2 a bottom portion of the boss or bracket 40 protrudes between the formations 44 and 46 of the upper module 11. However, the formations and the bracket 40 are shaped so as to avoid fouling of the lower formation 46 on the bracket 40.

FIG. 2 shows an alternative form of divider 34*a*. FIG. 2*a* shows the divider 34*a* in perspective.

Divider 34*a* includes a laminar member 35*a* similar to the laminar member 35 of divider 34 shown in FIG. 1. However, instead of having a member of cranked profile extending perpendicular to laminar member 35, divider 34*a* instead has an n section member 36*a* extending perpendicular to laminar member 35*a*.

The spacing between the downwardly depending limbs of the n-shaped member 36*a* is slightly greater than the thickness of the walls 12, 17 at the front of each respective module. It will thus be apparent that the n-shaped member 36*a* may simply be fitted over the upper, free end of such a wall 12, 17 in order to provide a slidable support for the divider.

Since the length L of each n-shaped member 36*a* is short compared with the overall length of the display apparatus in the transverse direction, the divider 34*a* may be employed even when the upper, free edge of a wall such as wall 12 or wall 17 is non-rectilinear.

Divider 34*a* has the advantage that it may be positioned with the laminar member 35*a* projecting either forwardly or rearwardly relative to the wall to which it is slideably secured. Thus the divider may serve to divide either the recess forward of it, or the recess to the rear of it, at the option of the user of the display apparatus.

The FIG. 2 embodiment of the invention omits the channel 32 visible in FIG. 1. Of course, if desired, the FIG. 1 embodiment may readily be positioned in a vertical orientation identical to that of FIG. 2, notwithstanding the use of the alternative divider 35*a*.

Figure 3A:
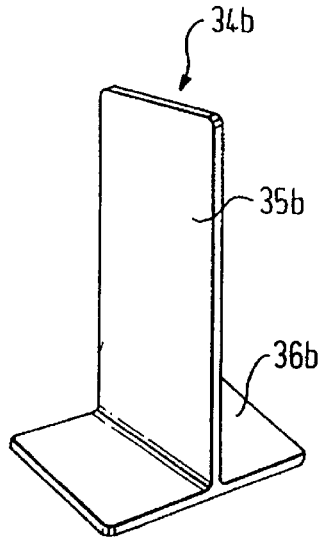
Figure 3B:
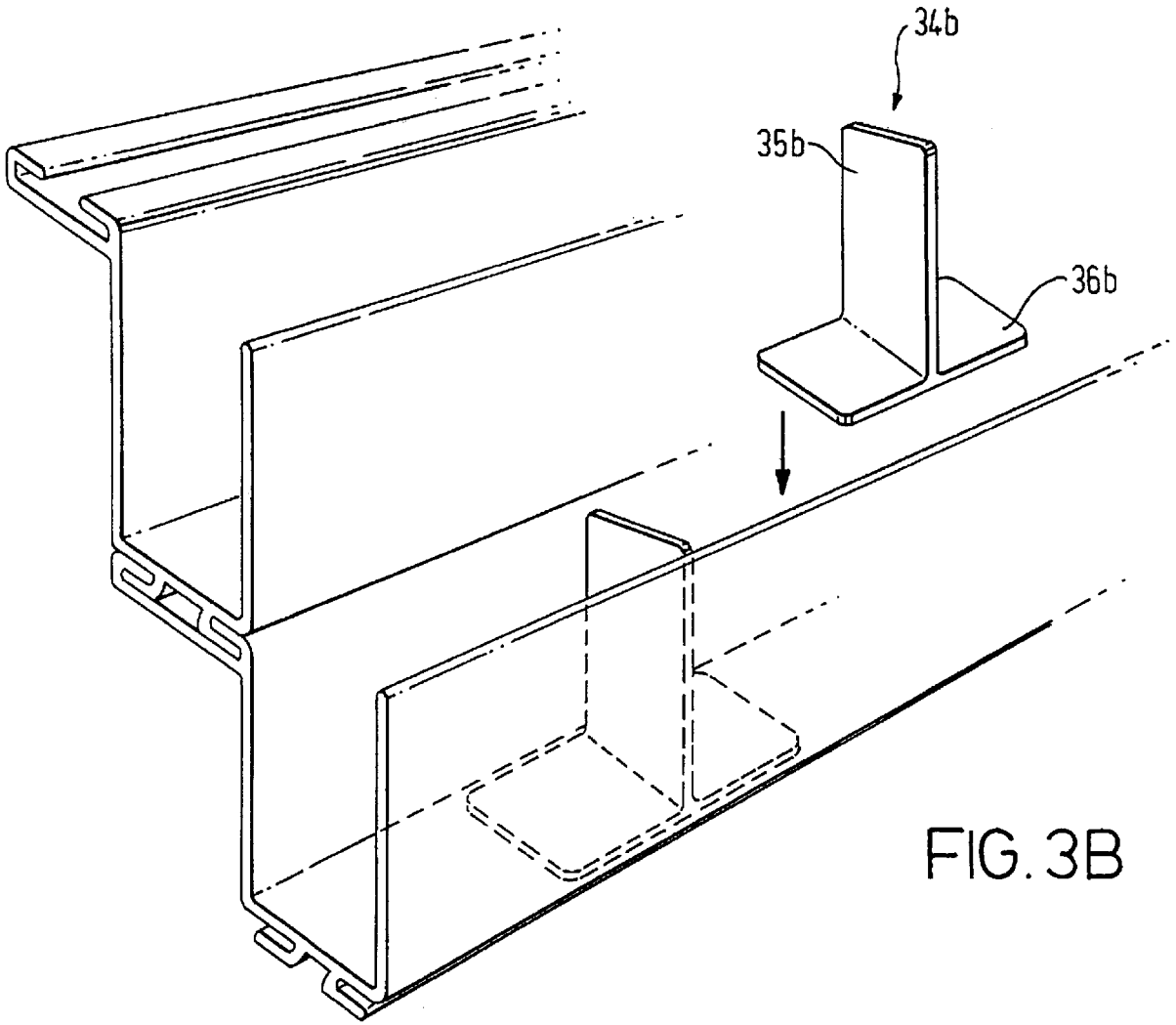

FIG. 3 shows another form of divider 34*b*. FIGS. 3*a* and 3*b* show the divider 34*b* in perspective.

Divider 34*b* includes a laminar upstand 35*b* that is connected to a laminar foot member 36*b* to form a generally inverted T-shaped configuration. The bottom edge of laminar upstand 35*b* is angled relative to the base of the recess defined by the module in which the divider 34*b* is to be positioned.

The angle of the bottom edge of the laminar upstand 35*b* ensures that when divider 34*b* is positioned to divide the recess, the laminar foot member 36*b* attached at right angles to this bottom edge, lies flat against the bottom wall 14 or 19 of the module. The laminar upstand 35*b* then extends upwards between and generally parallel to, the side walls 12 and 13, or 17 and 18 of the module in which it is positioned as can be seen in FIG. 3*b*.

Figures 4, 4A:
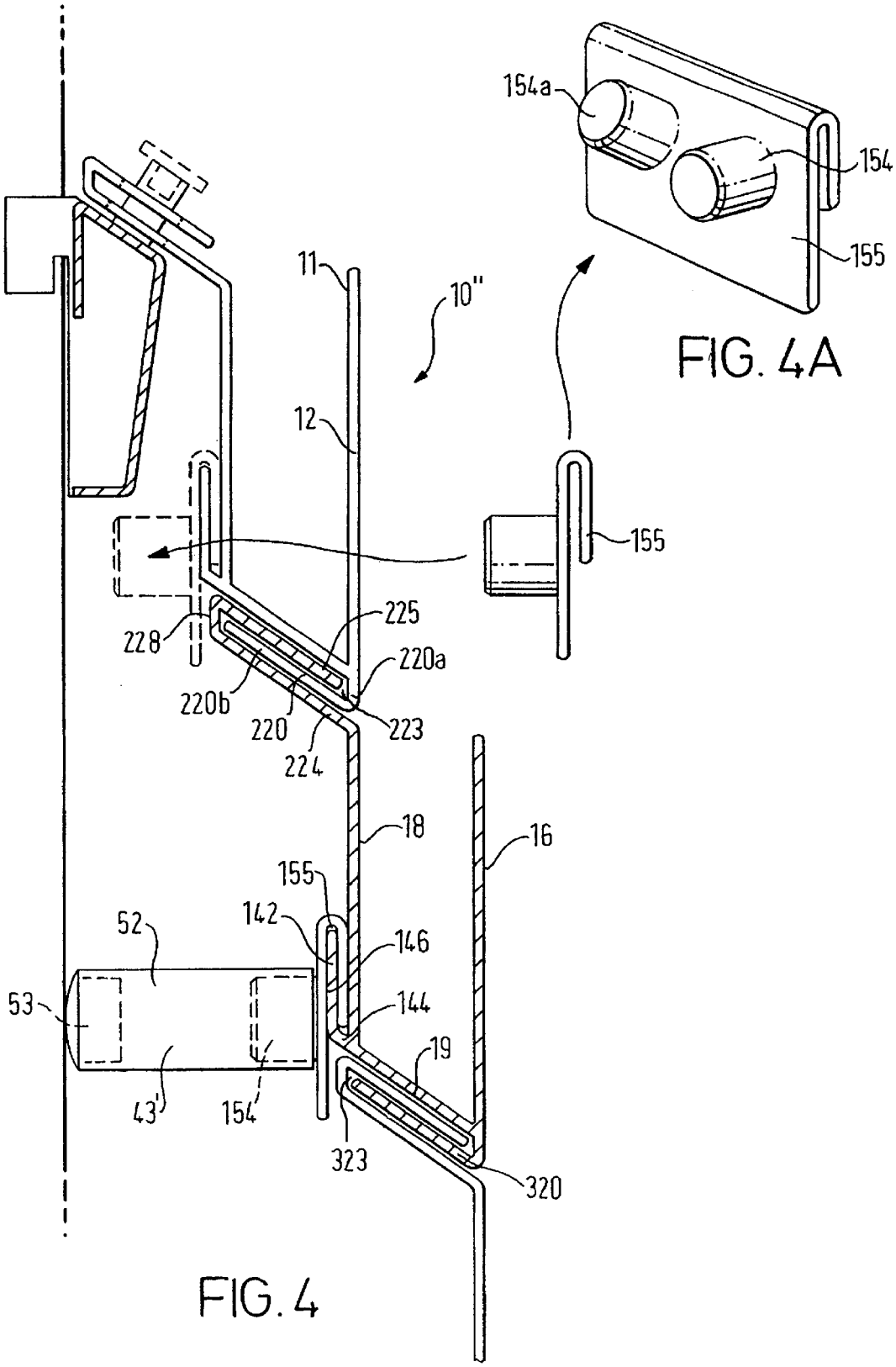

Referring now to FIG. 4 there is shown a further embodiment of the invention.

In the FIG. 4 embodiment of the display apparatus 10", the connector part secured on the base portion of the upper module 11 includes a single flanged member 220.

This flanged member includes a generally downwardly extending wall 220*a* protruding parallel to the front wall 12, from the front edge of the bottom wall 14; and a respective flange 220*b* extending generally parallel to the base wall 14.

The flange 220*b* extends from the front to the back edge of bottom wall 14. The flange member 220 hence defines a member for engagement with a connector part located at the top of the first lower module 16. The connector part at the top of the first lower module 16 includes a single slot member 223. This slot member 223 is defined by an elongate plate 224 extending from the upper end of rear wall 18, at an angle substantially parallel to that of the bottom wall 14 of the upper module 11, when walls 12 and 18 lie parallel to each other.

Extending parallel to plate 224, and spaced a short vertical distance above it, is a flange 225. Flange 225 is connected to plate 224 by means of an upstanding wall 228 as shown.

It will thus be apparent that by inserting flange member 220 of upper module 11 into the slot 223 at the top of the first lower module 16, the two modules may be joined together in a releaseable manner such that the first lower module 16 is suspended beneath upper module 11.

Bottom wall 19 of first lower module 16 includes connector parts similar to those on bottom wall 14 of upper module 11. Thus one or more further articles may be suspended from first lower module 16, in a manner as described in relation to FIG. 1.

FIG. 4 also shows another slot arrangement 142, on the outer surface of the rear wall 18, for a strut 43.

Slot 142 is defined by a wall 144 that extends outwardly from the base of the rear wall 18, parallel to the bottom wall 19; and a flange member 146 that extends upwardly from wall 144, parallel to the rear wall 18.

Strut 43 is almost identical to strut 43 of FIG. 1. However in this embodiment the end of tubular member 52 adjacent the display apparatus 10 receives therein a first bung 154 or a second bung 154*a*, (FIG. 4*a*), both of which are provided on a strut connector plate 155. Bungs 154 and 154*a* are laterally spaced from one another and project from plate 155 at mutually divergent angles.

The strut connector plate 155 (FIG. 4*a*) is an n-shaped member, one of its downwardly extending limbs being longer than the other, and the spacing between the downwardly extending limbs being slightly greater than the thickness of the flange 146 provided on the rear wall 18. The bungs 154, 154*a* project from the longer limb of the n shape.

When tubular member 52 is comparatively short, strut 43' spaces the lower portion of the display apparatus 10 from, e.g., the slot wall so that the modules 11, 16 extend substantially vertically (i.e., parallel to the slot wall etc.) when the strut is assembled as shown. In this arrangement the end of tubular member 52 adjacent the display apparatus 10 receives therein first bung 154, the longitudinal axis of which extends perpendicular to the plane of the strut connector plate 155.

When tubular member 52 is comparatively long, strut 43' spaces the lower portion of the display apparatus 10 further from, e.g., the slot wall so that the modules 11, 16 are supported at an angle relative to the slot wall. In this arrangement the end of tubular member 52 adjacent the display apparatus 10 receives therein second bung 154*a*, the longitudinal axis of which extends at an angle to the plane of the strut connector plate 155.

The length of the longer downwardly extending limb of strut connector 155 is such that in use it extends below the bottom wall 19, and prevents the engagement member 320 of module 16 from becoming disengaged from slot 323 of a lower article. For this reason, the strut connector plate 155 is not attached to the display apparatus 10, until after the modules have been assembled together. The strut connector plate 155 is attached to the display apparatus by inserting the comparatively shorter limb of the n shape into slot 142 so that the two limbs of the n shape straddle the flange member 146.

A strut connector 155 may be attached to each of the modules or articles making up the display apparatus, even if a strut 43' is not to be used for that particular module or article, to prevent disengagement of connector parts.

Figure 5:
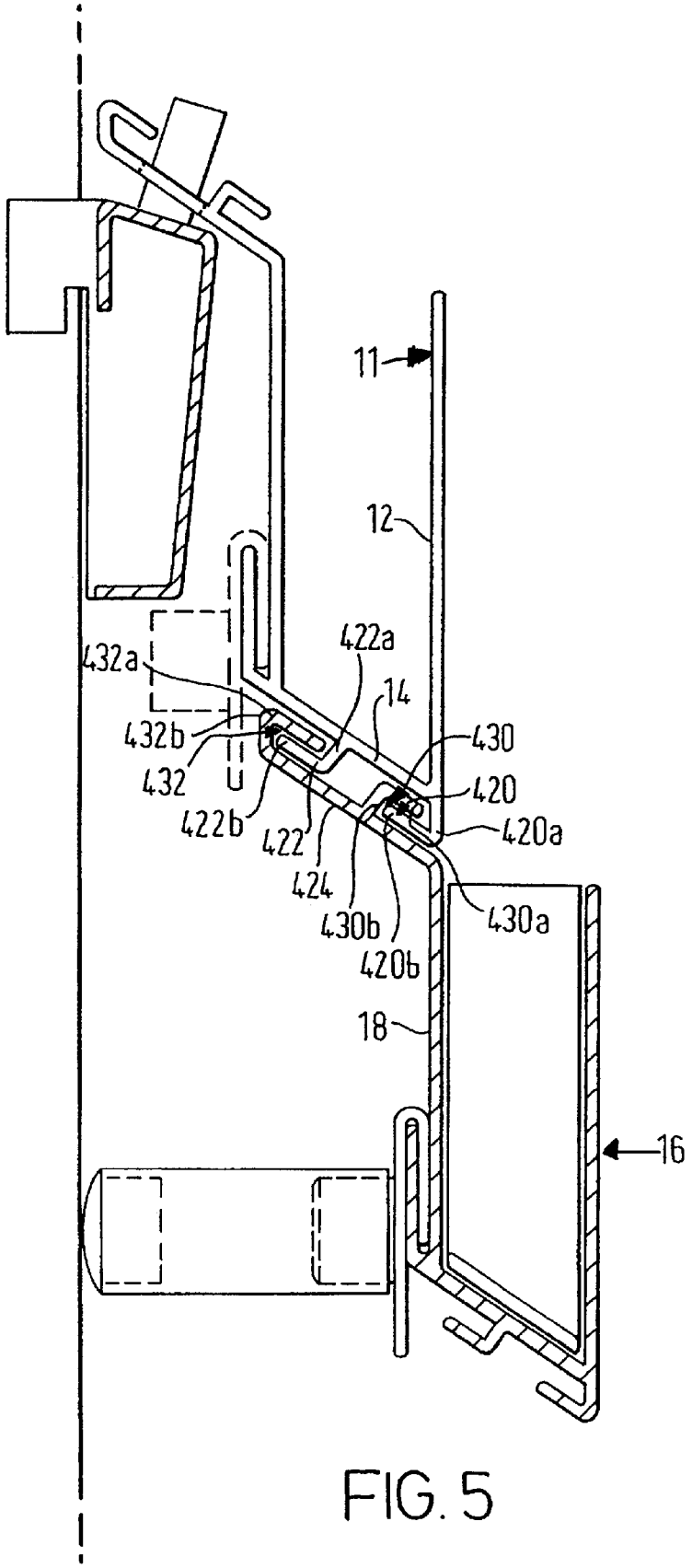
FIG. 5 is a side elevational view of a fifth embodiment of the invention.

Referring now to FIG. 5 there is shown yet a further embodiment of the invention.

In the FIG. 5 embodiment of the display apparatus 10, the connector parts secured on the base portion of the upper module 11 include two flanged members 420, 422.

These flanged members include generally downwardly extending walls 420*a*, 422*a* spaced apart and protruding parallel to the front wall 12 from the bottom wall 14; and respective flange members 420*b*, 422*b* extending generally parallel to the base wall 14 and in the same direction as each other, from the extending walls 420*a*, 422*a* towards the rear of the bottom wall 14.

The flanges 420*b*, 422*b* each extend only part-way along of the bottom wall 14, and hence the connector members define members for engagement with connector parts located at the top of the first lower module 16.

The connector part at the top of the first lower module 16 includes two slot members 430, 432. These slot members are defined by an elongate plate 424 extending from the upper end of the rear wall 18, at an angle substantially parallel to that of the bottom wall 14 of the upper module 11, when walls 12 and 18 lie parallel to each other.

Extending parallel to plate 424, and spaced a short vertical distance above it are two parallel flanges 430*a*, 432*a*. These flanges 430*a*, 432*a* are connected to plate 424 by two upstanding flanges 430*b*, 432*b* spaced apart from each other, and extending generally parallel to rear wall 18. The flanges 430*a*, 432*a* extend in the same direction from these upwardly extending flanges 430*b*, 432*b* towards the front edge of the plate 424.

It will thus be apparent that the flange members 420, 422 of upper module 11 may be engaged in the slots 430, 432 of the first lower module 16 to releaseably join the two modules together, such that the first lower module 16 is suspended beneath the upper module 11.

This embodiment is very similar to the embodiment shown in FIG. 4, except that the connector parts comprise two engagement members and two corresponding slots, rather than one engagement member and one corresponding slot. This embodiment is advantageous over the single engagement embodiment, as it is less likely to flex when articles are loaded into the recesses of the display apparatus.

Figure 6:
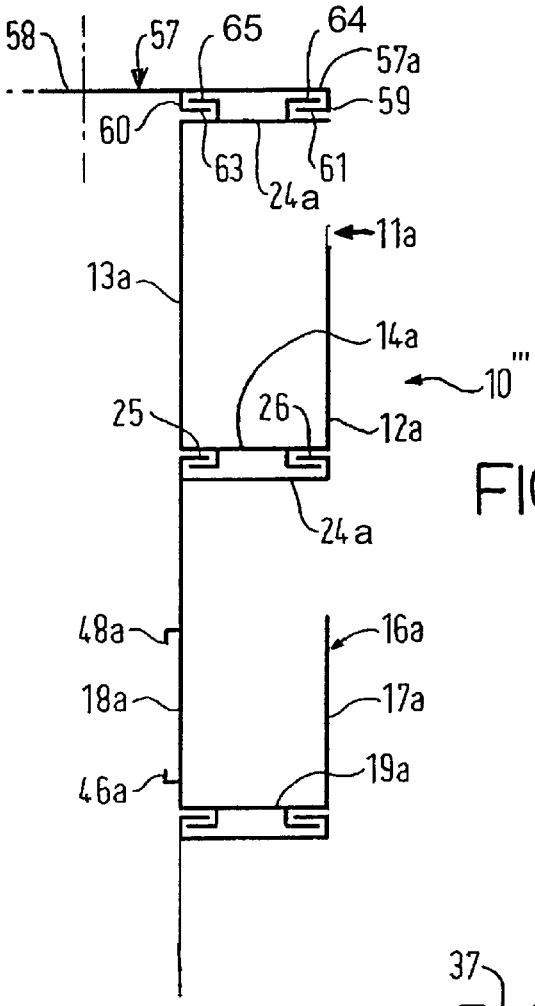
FIG. 6 is a schematic, side elevational view of a sixth embodiment of the invention.

Referring now to the FIG. 6 there is shown a further embodiment of the invention.

In the FIG. 6 embodiment of the display apparatus 10''', the bottom wall 14*a* of the upper module 11*a* and the bottom wall 19*a* of each lower module 16*a* extend generally perpendicular to the front and rear walls 12*a*, 13*a*, 17*a* and 18*a*. Thus the display apparatus 10 in normal use does not fan the articles stored therein, because the bottom wall of each module is generally horizontal in use.

The elongate plate 24*a* at the top of each module forming part of the mutually engageable connector parts extends forwardly of each rear wall 13*a*, 18*a* in the embodiments shown. The flanges 25, 26 are disposed above the plates 24*a* in the lower modules 16*a*. On assembly of the display apparatus 10 of FIG. 6 the result is a non-tiered, vertical display whose lateral protuberance from, e.g., a slot wall is limited.

The lower module 16*a* of FIG. 6 includes slots 46a, 48*a* similar to the slots of the embodiments of FIGS. 1 and 2. However, unless it is required to provide adjustability of the angle at which the FIG. 6 embodiment may hang, the slots 46*a*, 48*a* need each only define a single, n-shaped slot for receipt of the flange 55 of the strut.

The uppermost module 11*a* is suspended from a bracket 57, that includes a through going aperture indicated schematically at 58 for suspension from a pin such as pin 38 shown in FIG. 1.

Bracket 57 includes a horizontally extending plate 57*a* from the underside of which depend downwardly two walls 59, 60 that respectively terminate in opposed horizontally spaced flanges 61, 63. The plate 57*a*, the walls 59, 60 and the flanges 61, 63 define a T-slot in which may be slideably received a pair of flanges 64, 65 that are mutually parallel and are supported spaced a short distance above the upper surface of the top wall 66 of upper module 1 la. The flanges 64, 65 extend in opposite directions when viewed in cross section. Thus the flanges 64, 65 and the short upstanding walls that support them define a T-shaped combination that may be slideably inserted into the two slots defined by the walls 59, 60 and flanges 61, 63 for suspending the display apparatus 10.

If desired, instead of each module having plate 24 defining a top wall that overlies the recess, it is equally possible for the plates 24 of the respective modules to extend upwardly rearwardly of the associated modules of FIG. 1. Obviously in such an arrangement a tiered display apparatus, that would not fan articles, would result.

Also, in such an arrangement, it is clear that the bracket 57 needed in the FIG. 6 embodiment as shown could then be dispensed with. A suspension arrangement similar to that shown in FIGS. 1 and 2 could be adopted instead.

Figure 7:
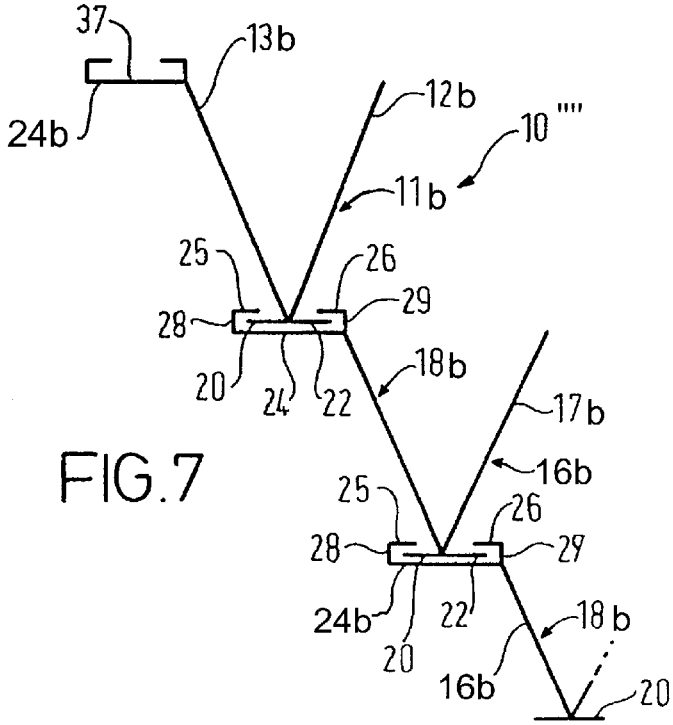
FIG. 7 is a schematic, side elevation view of a seventh embodiment of the invention.
Figure 8:
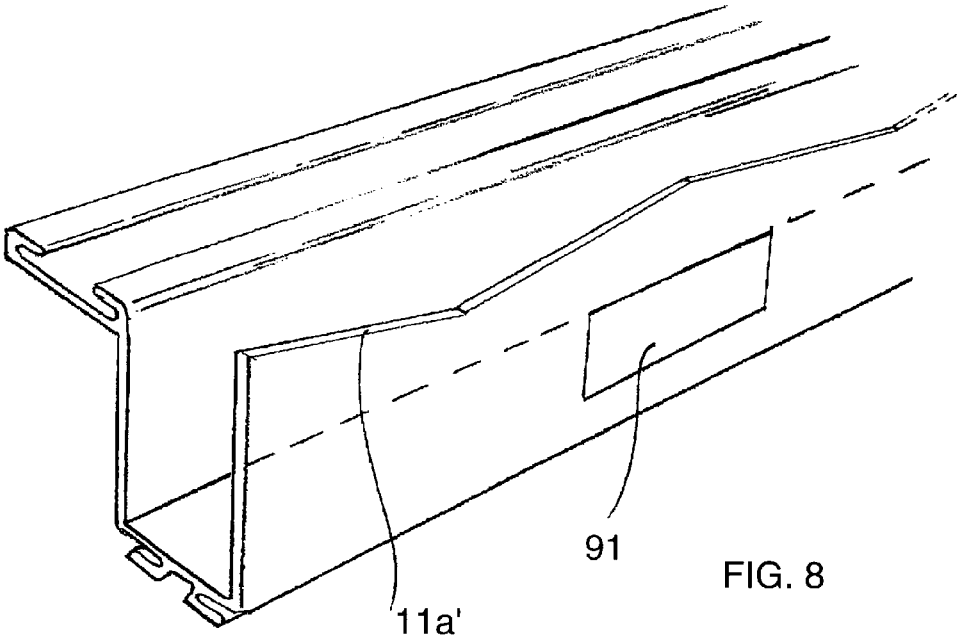
FIG. 8 shows a variant of the lower module visible in FIG. 3*b*, that is modified to include a non-rectilinear free edge of the front, upstanding wall; and that includes in schematic form ornamentation visible on the aforesaid front wall.

FIG. 7 shows yet a further variant of the display apparatus 10 of the invention.

FIG. 7 shows yet a further variant of the display apparatus 10"" of the invention.

In this embodiment, the upstanding walls 12*b*, 13*b*, 17*b*, 18*b* of the respective modules are mutually interconnected at the base of each module 11*b*, 16*b*.

The upper, free edge of each rear wall 13, 18 of each module includes a combination of a plate 24, flanges 25, 26, upstand 28 and extension 29, to define an elongate, T-shaped slot that is similar to the slot shown in the embodiment of FIGS. 1 and 2.

The flange members 20 and 22 extend respectively to the rear and the front of each module, being connected to the associated module at the base thereof (i.e., at the junction between the front and rear walls of the module). Thus there is no need for the wall portions 20*a*, 22*a* to space the flange members 20, 22 downwardly from the underside of each module.

On assembly, each module 11, 16, etc. may be assembled to a position suspended below the next uppermost module, in a manner similar to that shown in FIGS. 1 to 6.

Each plate 24 may include the aperture 37 by means of which the module designated the uppermost module may be suspended from a pin such as pin 38 as shown in FIG. 1.

Although not visible in FIG. 7, an arrangement of members defining slots such as those designated 44, 46, 50 in FIG. 1 may of course be secured to the elements of the modules 11, 16 of FIG. 7.

The modules of the display apparatus 10 that are assembled into a display typically are identical to or similar to one another, in order to ease production and stockholding. However, as is evident from the variety of module types described herein, it is equally possible to combine modules of differing designs in a single display.

Preferably the modules are manufactured from a material such as acrylic, which may readily be self-coloured or transparent, depending on the precise requirements for the display.

As is evident from the cross sections shown in the figures, each module may easily be manufactured as an elongate extrusion. Consequently, the manufacture of each module is advantageously quick to achieve. Also, through use of per se known extrusion technology, the quality and integrity of the modules may be assured.

Nonetheless, other methods of manufacturing the modules may of course be employed if desired. If as preferred the modules are manufactured from acrylic or polycarbonate, they may be fabricated from a series of acrylic or polycarbonate panels that can be welded together, e.g., by heat or ultrasound welding. Alternatively the modules of the invention may be manufactured from other plastics materials, from metal, or even from formable natural materials such as timber.

What is claimed is:

1. A modular display apparatus comprising, a one piece upper module having at least two upstanding walls interconnected at a base portion of the upper module and defining a first receptacle, that is open at its upper end, for receiving articles for display;

and at least a first, lower one piece module, supported beneath the upper module, the first, lower module having at least two upstanding walls, interconnected at a base portion of the first lower module and defining a further receptacle, that is open at its upper end, for receiving articles for display, the base portion of the upper module and an upper portion of the first, lower one piece module respectively including mutually engagable hanger parts releasably hanging the lower one piece module beneath the upper one piece module so as to permit access of articles via each of the receptacles, the hanger parts, when mutually engaged, defining a substantially rigid joint whereby the apparatus is self supporting when assembled.

2. A display apparatus according to claim 1 wherein, the upper module includes a suspender for suspending the apparatus from a location adjacent its uppermost point.

3. A display apparatus according to claim 1 wherein, the upper module includes a suspender for suspending the apparatus for a location adjacent its uppermost point; and wherein the suspender permits pivoting of the apparatus about an horizontal axis.

4. A display apparatus according to claim 1 wherein, the upper module includes a suspender for suspending the apparatus from a location adjacent its uppermost point; and the apparatus further including secured thereto at a location below the suspender, a strut that, in use interconnects the apparatus and a surface adjacent thereto, whereby the strut spaces a portion of the apparatus below the suspender from the surface.

5. A display apparatus according to claim 1 including, a further lower module supportable beneath the first lower module, the further lower module including at least two upstanding walls, interconnected at a base portion of the further lower module and defining another receptacle, that is open at its upper end, for receiving articles for display, the base portion of the first, lower module and an upper portion of the further, lower module respectively including further mutually engagable hanger parts for releasably securing the, further, lower module beneath the first lower module so as to permit access of articles via each of the receptacles.

6. A display apparatus according to claim 1 including, a further lower module supportable beneath the first lower module, the further lower module including at least two upstanding walls, interconnected at a base portion of the further, lower module and defining another receptacle, that is open at its upper end, for receiving articles for display, the base portion of the first, lower module and an upper portion of the further, lower module respectively including further mutually engagable hanger parts for releasably securing the further, lower module beneath the first lower module so as to permit access of articles via each of the receptacles, the further mutually engagable hanger parts, when mutually engaged, defining a substantially rigid joint whereby the apparatus is self-supporting when assembled.

7. A display apparatus according to claim 1 wherein, at the open, upper end of each receptacle the upstanding walls of each module are horizontally spaced from one another to define front and rear walls of each module, the rear wall of each lower module being substantially contiguous with the front wall of the upwardly adjoining module when the modules are connected together.

8. A display apparatus according to claim 1 wherein, at the open, upper end of each receptacle the upstanding walls of each module are horizontally spaced from one another to define front and rear walls of each module, the rear wall of each lower module being substantially contiguous with the front wall of the upwardly adjoining module when the modules are connected together; and wherein a boundary between said rear wall of a lower module and said front wall of the upwardly adjoining module is non-rectilinear.

9. A display apparatus according to claim 1 wherein, at the open, upper end of each receptacle the upstanding walls of each module are horizontally spaced from one another to define front and rear walls of each module, the rear wall of each lower module being substantially contiguous with the front wall of the upwardly adjoining module when the modules are connected together; and wherein the rear wall of each lower module is generally parallel to the front wall of the upwardly adjoining module when the modules are connected together.

10. A display apparatus according to claim 1 wherein, the upstanding walls of at least one of the modules are of generally equal heights.

11. A display apparatus according to claim 1 wherein, the upstanding walls of at least one of the modules are of unequal heights.

12. A display apparatus according to claim 1 wherein, at its open, upper end the upstanding walls of at least one of the receptacles are horizontally spaced one from another to define front and rear walls, at least the front wall including ornamental features.

13. A display apparatus according to claim 1 wherein, at its open, upper end the upstanding walls of at least one of the receptacles are horizontally spaced one from another to define front and rear walls, the free, upper edge of the front wall being non-rectilinear.

14. A display apparatus according to claim 1 wherein, the mutually engagable hanger parts include a slot and member slidably receivable in the slot so as to be form-lockingly engagable therewith, the slot being secured on an upper part of the lower module; and the member being secured on the exterior of the base portion of the upper said module.

15. A display apparatus according to claim 1 wherein, the mutually engagable hanger parts include at least two slots and at least two engagement members engageably receivable in the slots, the slots being secured to an upper part of the lower module; and the engagement members being secured on the exterior of the base portion of the upper module.

16. A display apparatus according to claim 1 wherein, the base portion of at least one said module of which includes a wall interconnecting the upstanding walls of the module, thereby spacing the walls from one another and permitting them to lie parallel to one another.

17. A display apparatus according to claim 1 wherein, the base portion of the modules are "V" shaped at the conjunction of the two upstanding walls.

18. A display apparatus according to claim 1 wherein, the interior of at least one of the receptacles includes a plurality of transversely extending ribs for preventing laminar items from slipping when displayed in the apparatus.

19. A display apparatus according to claim 1 wherein, at least one of the walls of said module thereof includes formed therein an elongate channel, the apparatus including a divider member for the receptacle of the module, the divider member including a projection that is slidably retainable in the channel so that the divider is slidably locatable in a plurality of positions in the receptacle.

20. A display apparatus according to claim 1 wherein, said modules have a flange extending transversely from a said upstanding wall, the flange defining one of the hanger parts.

21. A display apparatus according to claim 1 wherein, the upper module includes a flange having formed therein an aperture permitting pivotal suspension of the display apparatus from a hook.

22. A display apparatus according to claim 1 wherein at least one of the modules includes a slot provided adjacent its base portion for receiving an engagement member of corresponding profile to the slot and connected to a strut, the strut being for bracing the apparatus, at a location below the top of the upper module, relative to a fixed surface; and wherein the engagement member is integral with a strut connector; wherein the strut is open-ended; wherein the strut connector includes a plurality of tubular projections protruding therefrom; and wherein the strut connector is connected to the strut by means of insertion of one of the tubular projections, into the open end of the strut; the tubular projections being formed so that when each of said projections is inserted, in turn, into the open end of the strut, said apparatus is braced in a series of positions relative to the fixed surface.

23. A display apparatus according to claim 1 including a divider member having a laminar portion and, extending generally perpendicular thereto, an n-shaped portion that slidingly fits over the free upper edge of one of the upstanding walls to act as a slidably movable divider for a said receptacle.

24. A display apparatus according to claim 1 including a free standing divider member having two planar portions connected at right angles to each other to form a generally inverted T-shaped cross-section that matches the relative angular orientation of the upstanding walls and the base portion of an associated said module, the free standing divider member being insertable into one of the receptacles to act as a movable divider therefore.

25. A display apparatus according to claim 1 wherein, the upstanding walls are a front wall and a rear wall with the front wall shorter than the rear wall and affords access to the articles placed in the module through the aperture in the top of the front wall due to its shorter length, the rear wall having a roof portion over the base portion, the roof portion and base portion being parallel and the back wall being perpendicular to both the roof portion and the base portion.

* * * * *